US005835811A

United States Patent [19]

Tsumura

[11] Patent Number: 5,835,811

[45] Date of Patent: Nov. 10, 1998

[54] PHOTOSENSITIVE MATERIAL PROCESSING APPARATUS

[75] Inventor: Kazunori Tsumura, Wakayama, Japan

[73] Assignee: Noritsu Koki Co., Ltd., Wakayama, Japan

[21] Appl. No.: 705,679

[22] Filed: Aug. 30, 1996

[30] Foreign Application Priority Data

Aug. 31, 1995 [JP] Japan ..... 7-246892

[51] Int. Cl.[6] ..... G03D 13/02; G03D 17/00

[52] U.S. Cl. ..... 396/598; 396/636

[58] Field of Search ..... 396/612, 620, 396/622, 626, 630, 627, 598, 636, 641

[56] References Cited

U.S. PATENT DOCUMENTS

| | | | |
|---|---|---|---|
| 4,613,221 | 9/1986 | Takase et al. | 396/618 |
| 4,763,152 | 8/1988 | Blackman | 396/618 |
| 4,775,873 | 10/1988 | Blackman et al. | 396/618 |

FOREIGN PATENT DOCUMENTS

| | | | |
|---|---|---|---|
| 60-209736 | 10/1985 | Japan | 396/937 |
| 62-280740 | 12/1987 | Japan | 396/937 |

*Primary Examiner*—D. Rutledge

*Attorney, Agent, or Firm*—Oblon, Spivak, McClelland, Maier & Neustadt, P.C.

[57] ABSTRACT

A photosensitive material processing apparatus including a processing tank and a rack disposed within the processing tank so as to transport a photosensitive material. A pair of rack parts, such as a rack plate and a back plate, which form a side surface of the rack, are joined together to form a duct. Another pair of rack parts, such as a turn guide and a turn cover, which form the bottom portion of the rack, are joined together to form another duct. Slits for jetting a processing solution are provided in a rack part which forms a transport path as well as the duct. Also, a solution exit is provided so as to allow the processing solution to flow out from the transport path to the outside of the rack. The processing tank is provided with a pump and a subtank. Also, a port is provided in the bottom wall of the processing tank to supply the processing solution into the tank. The processing solution supplied into the tank flows upward through the ducts, so that the processing solution is jetted from the slits to the photosensitive material. The jetted processing solution is discharged from of the rack through the solution exit.

1 Claim, 9 Drawing Sheets

PHOTOSENSITIVE MATERIAL PROCESSING APPARATUS

BACKGROUND OF THE INVENTION

1. Field of the Invention

The present invention relates to the structure of a rack used in a processing tank of a photosensitive material processing apparatus, and more particularly to means for circulating a processing solution in an automatic film developing apparatus.

2. Description of the Related Art

In a conventional photosensitive material processing apparatus for carrying out automatic development of a photosensitive material, the steps of color development, bleaching, fixing, and stabilizing have been performed in a color development process. In the steps of color development, dyes are produced while free silver, which forms latent images in sensitized portions, is reduced. In the steps of bleaching, the silver, which forms latent images at the color-developed portions, is oxidized to be returned to the form of a silver salt. In the step of fixing, the silver salt is converted into a water soluble complex salt, and is removed. In the step of stabilizing, color-generating components in non-sensitized portions are deactivated so as to complete the development process. Through this process, stable images are obtained.

Various techniques have been employed so as to reduce the amount of a processing solution required in the development process from the viewpoint of cost and liquid waste treatment. In order to maintain the activity of the processing solution at a proper level for a prolonged period of time, a reaction accelerator, a reaction inhibitor, and/or various kinds of additives for suppressing exhaustion of the processing solution have been added. Also, a development process which does not require water washing has been developed. Moreover, the processing solution is agitated and circulated so as to enhance or maintain the activities of the processing solution and photosensitive material, to stabilize the processing performance using a small amount of a processing solution, and to eliminate developer streaks.

An example of a processing tank of a conventional photosensitive material processing apparatus will be described. FIG. 1 (PRIOR ART) is a cross-sectional view showing the bottom of a processing tank and a rack of a conventional photosensitive material processing apparatus. As shown in FIG. 1 (PRIOR ART), a rack 48 accommodated within a processing tank 47 is designed to transport films 43 by using hourglass-shaped rollers 41 and sprockets 42. The processing tank is provided with shower pipes 45 and 46. The processing solution is Jetted from the shower pipes 45 and 46 to a film, as indicated by arrows in FIG. 1 (PRIOR Art), so as to accelerate and stabilize reactions such as development. The processing solution is circulated within the processing tank.

FIG. 2 (PRIOR Art) shows a shower pipe used in the processing tank of the conventional photosensitive material processing apparatus. As shown in FIG. 2 (PRIOR Art), a great number of small holes are formed on the side of each shower pipe which faces film. A processing solution is jetted from the small holes by means of the discharge pressure of a pump and the water pressure. The shower pipe causes a uniform reaction over the film, thereby preventing the occurrence of developer streaks.

As described above, in the conventional photosensitive material processing apparatus, processing is carried out uniformly over the entire surface of film by jetting a processing solution from the shower pipe. During continuous operation, crystals of components of the processing solution adhere to the holes of the shower pipe, or dirt blocks the holes of the shower pipe. Therefore, maintenance work such as washing must be performed so as to cope with the above problems. However, even when such maintenance work is performed, the holes of the shower pipe gradually become blocked, and it becomes difficult to remove substances which block the holes. Accordingly, the shower pipe must be changed frequently.

In the conventional photosensitive material processing apparatus, such a shower pipe is provided on a processing tank so as to jet a processing solution toward film which is moved by the rack within the processing tank, thereby promoting the circulation of the processing solution. Since a space for installing the shower pipe must be provided within the processing tank, the size of the processing tank increases, thus making it difficult to reduce the amount of the processing solution.

SUMMARY OF THE INVENTION

An object of the present invention is to provide an improved processing tank and rack that make it possible to circulate a processing solution without increasing the installation space, that facilitate maintenance, and that reduce the amount of the processing solution and the size of the processing tank.

To achieve the above object, in a photosensitive material processing apparatus according to the present invention, a rack used in a processing tank has a duct which is formed by combining rack parts and through which a processing solution flows. Also, a rack part which forms the duct and which faces a transport path for a photosensitive material has slits for jetting the processing solution. The processing solution flowing into the duct from a solution-introduction port of the processing tank is caused to flow upward within the duct, so that the processing solution is jetted from the slits to the photosensitive material. A solution exit is properly provided in the rack part so as to discharge to the outside of the rack the processing solution which flows upward through the duct within the rack and jets from the slits to the transport path. The processing solution is then circulated within the processing tank. The structure of the rack is equivalent to the structure in which shower pipes for jetting the processing solution are included in the processing tank and the rack.

A transport path for a photosensitive material is provided on each of a downward transport side where the photosensitive material is transported downward in the processing tank and an upward transport side where the photosensitive material is transported upward in the processing tank after the direction of travel of the photosensitive material is changed at the bottom of the processing tank. The duct of the present invention can be provided on both the upward and downward transport sides. Taking this fact into consideration, the solution-introduction port for introducing the processing solution into the processing tank is provided at a proper location on the sidewall or bottom wall of the processing tank. However, in the photosensitive material processing apparatus according to the present invention, the solution-introduction port is preferably provided in the bottom wall of the processing tank, based on the viewpoint of proper circulation of the processing solution and the structure of the ducts formed within the rack. When the solution-introduction port is provided in the bottom wall of the processing tank, a water pressure suitable for jetting the processing solution from slits can be created within the ducts provided on the downward and upward transport sides even in the case where the processing solution is circulated in a conventional manner by using a subtank and a pump provided for the processing tank.

The ducts formed by rack parts can have a separable structure, if sufficient sealing can be provided at the joint surfaces through which the rack parts are joined to each other. Since the rack can be easily disassembled and assembled, maintenance and parts exchange can be performed easily. Also, it is possible to cope with changes in the specifications.

In the rack used in the photosensitive material processing apparatus according to the present invention, a back plate and a lower turn cover are respectively joined with a rack plate which forms a sidewall of the rack and a lower turn guide which forms the bottom portion of the rack. The rack plate and the back plate form a space serving as a duct, while the lower turn guide and the lower turn cover form another space serving as a duct. Slits are formed in the rack plate which faces the transport path for the photosensitive material, and a solution exit for discharging the processing solution is provided in the rack plate or the like facing the outside of the rack.

As described above, the ducts can be provided by the rack parts which can be disassembled. Therefore, complicated machining is not required, and the method of manufacturing parts can be selected from among the variety of molding methods, based on the intended purpose. Accordingly, the weight and cost of the parts can be decreased.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE INVENTION AND PREFERRED EMBODIMENT

Figure 1:
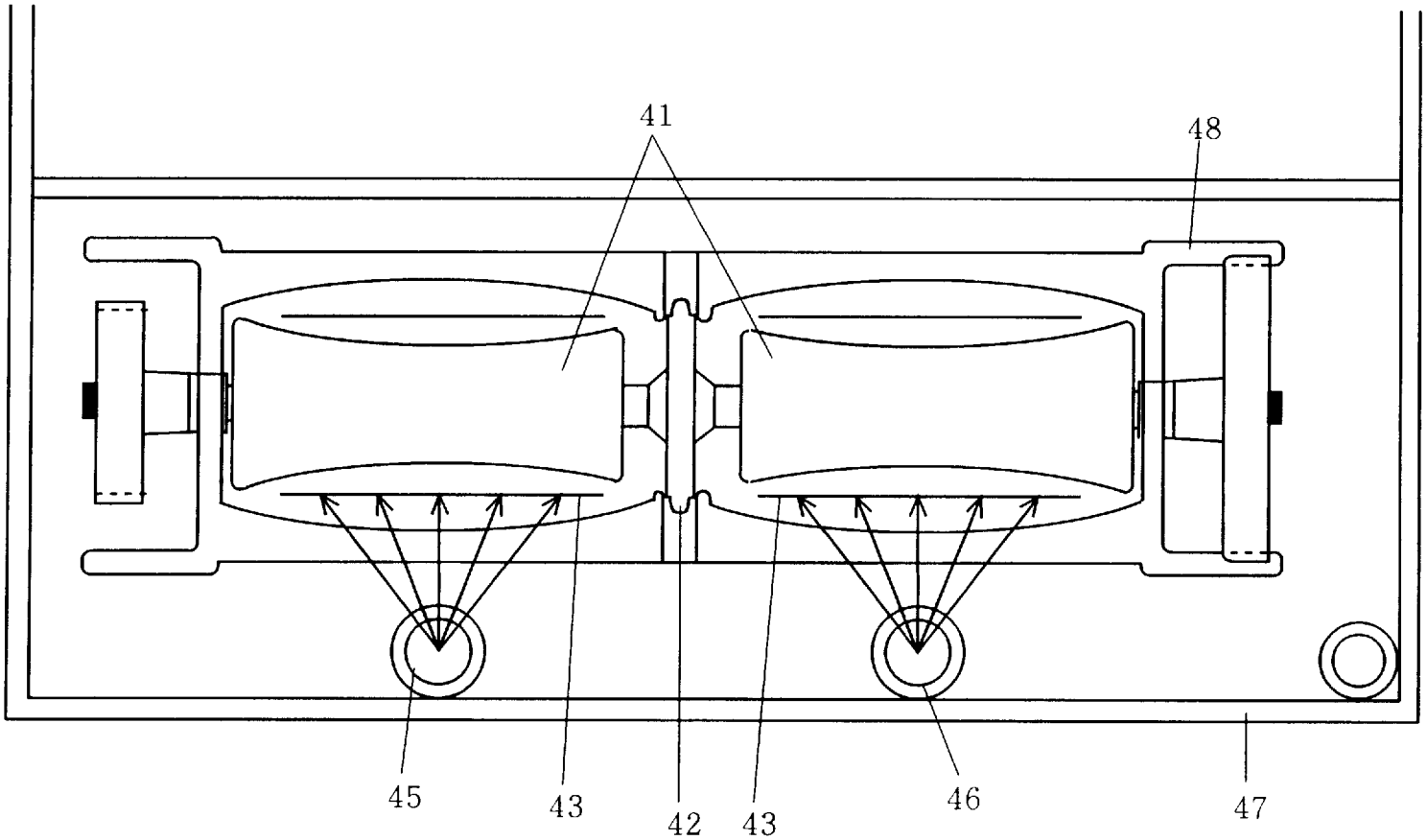
FIG. 1 (PRIOR ART)
FIG. 1 (PRIOR Art) is a schematic cross-sectional view of a processing tank of a conventional photosensitive material processing apparatus.
Figure 2:
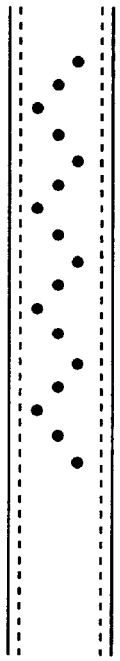
FIG. 2 (PRIOR ART)
FIG. 2 (PRIOR Art) is a view of a shower pipe used in the processing tank of the conventional photosensitive material processing apparatus.
Figure 3:
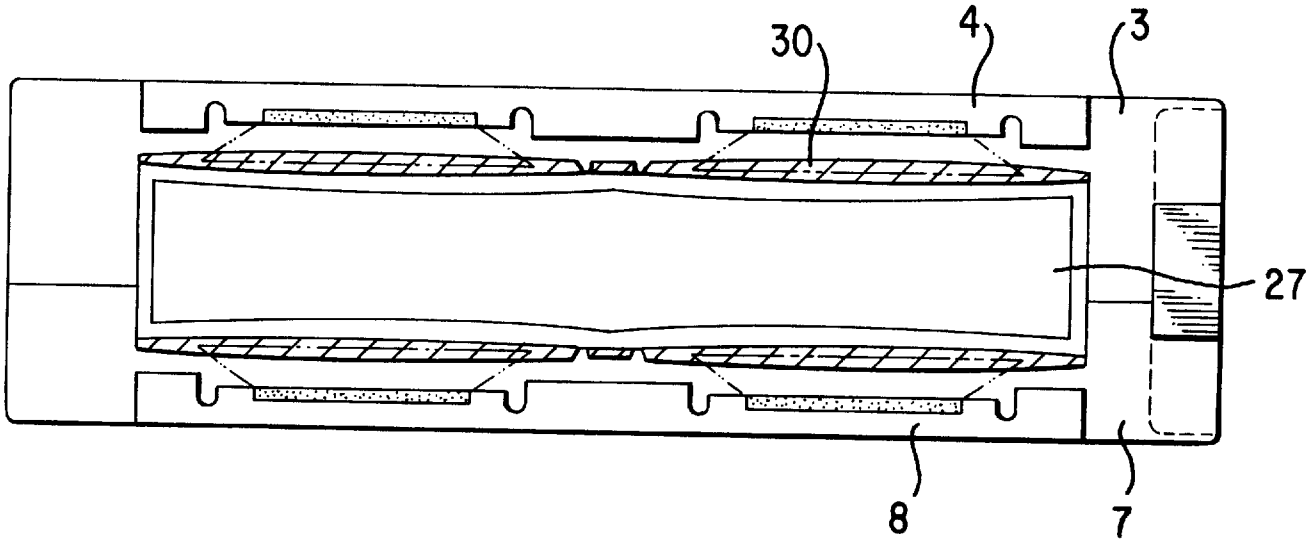
FIG. 3 is a cross-sectional view showing the structure of an example of a rack used in a photosensitive material processing apparatus of the present invention.

FIG. 3 shows the structure of an example of a rack used in a photosensitive material processing apparatus of the present invention. FIG. 3 is a cross section taken along line A—A in FIG. 9, which will be described as an embodiment. The upper portion of FIG. 3 is the inlet side of a rack, while the lower portion is the outlet side of the rack. An inlet-side back plate 4 and an outlet-side back plate 8 are joined to an inlet-side rack plate 3 and an outlet-side rack plate 7, respectively, so as to form ducts through which a processing solution flows. Dotted portions in FIG. 3 represent the ducts for the processing solution which is fed from a solution-introduction port of a processing tank. An intermediate plate 27 is disposed in the space formed by the inlet-side rack plate 3 and the outlet-side rack plate 7 so as to reduce the useless space. Films 30 travel along transport paths indicated by hatching in FIG. 3.

Figure 4:
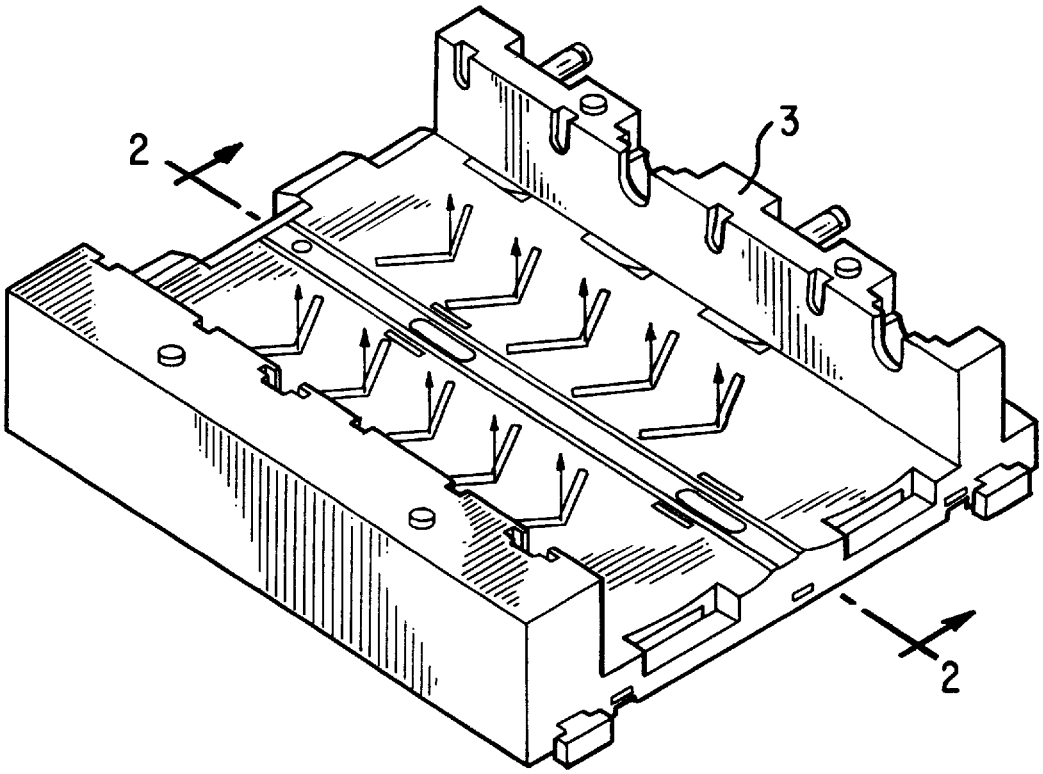
FIG. 4 is a perspective view showing the main structure of the rack shown in FIG. 3.

FIG. 4 shows the main structure of the rack shown in FIG. 3. FIG. 4 shows rack parts provided on the inlet-side of the rack. FIG. 4 is a view of the inlet-side rack plate 3 as viewed from the downstream side of the transport path. Arrows in FIG. 4 indicate circulation of the processing solution. The processing solution comes from the lower part of the rack, enters into the ducts formed within the rack plate 3, and flows along the ducts so as to jet from slits formed in the inlet-side rack plate 3.

Figure 5:
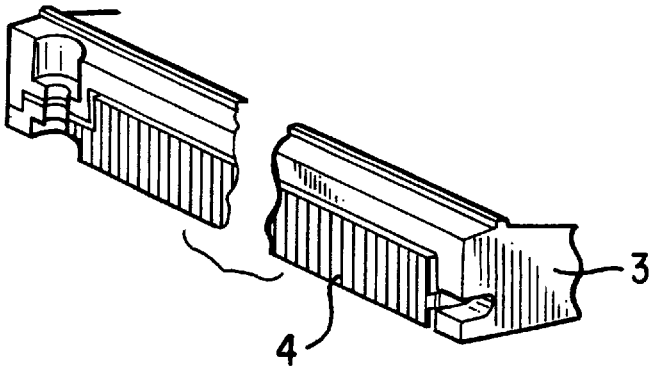
FIG. 5 is a cross-sectional view showing rack parts of the rack shown in FIG. 3.
Figure 6:
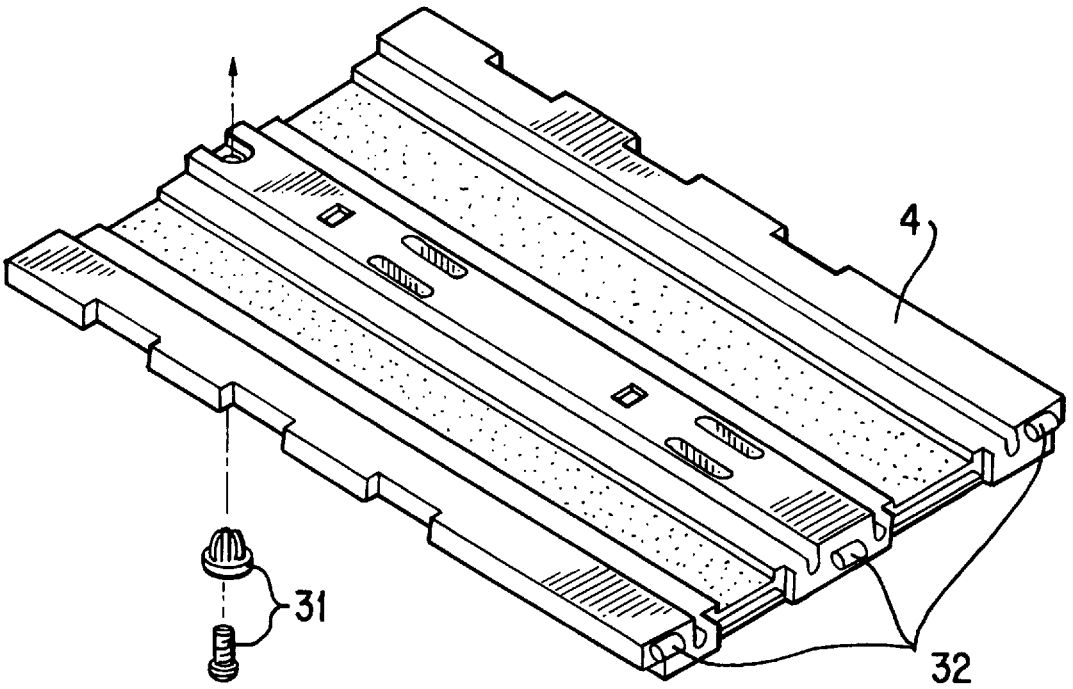
FIG. 6 is a perspective view showing the rack parts of the rack shown in FIG. 3.

FIG. 5 shows rack parts used in the rack shown in FIG. 3. FIG. 5 is a cross-sectional view taken along line B—B in FIG. 4. FIG. 6 also shows the rack parts used in the rack shown in FIG. 3. The inlet-side back plate 4 is attached to the back of the inlet-side rack plate 3. The inlet-side back plate 4 shown here is made through foaming. At one end of the back plate 4 are provided engagement members 32 which are fit into the inlet-side rack plate 3. The inlet-side back plate 4 is integrated with the inlet-side rack plate 3 by fitting the engagement members 32 into the rack plate 3 and fixing the other end of the back plate 4 to the rack plate 3 using a resin fastener 31. Dotted portions in FIG. 6 show ducts for the processing solution.

An automatic film developing apparatus having two transport paths will be described as an embodiment of the photosensitive material processing apparatus of the present invention.

Figure 7:
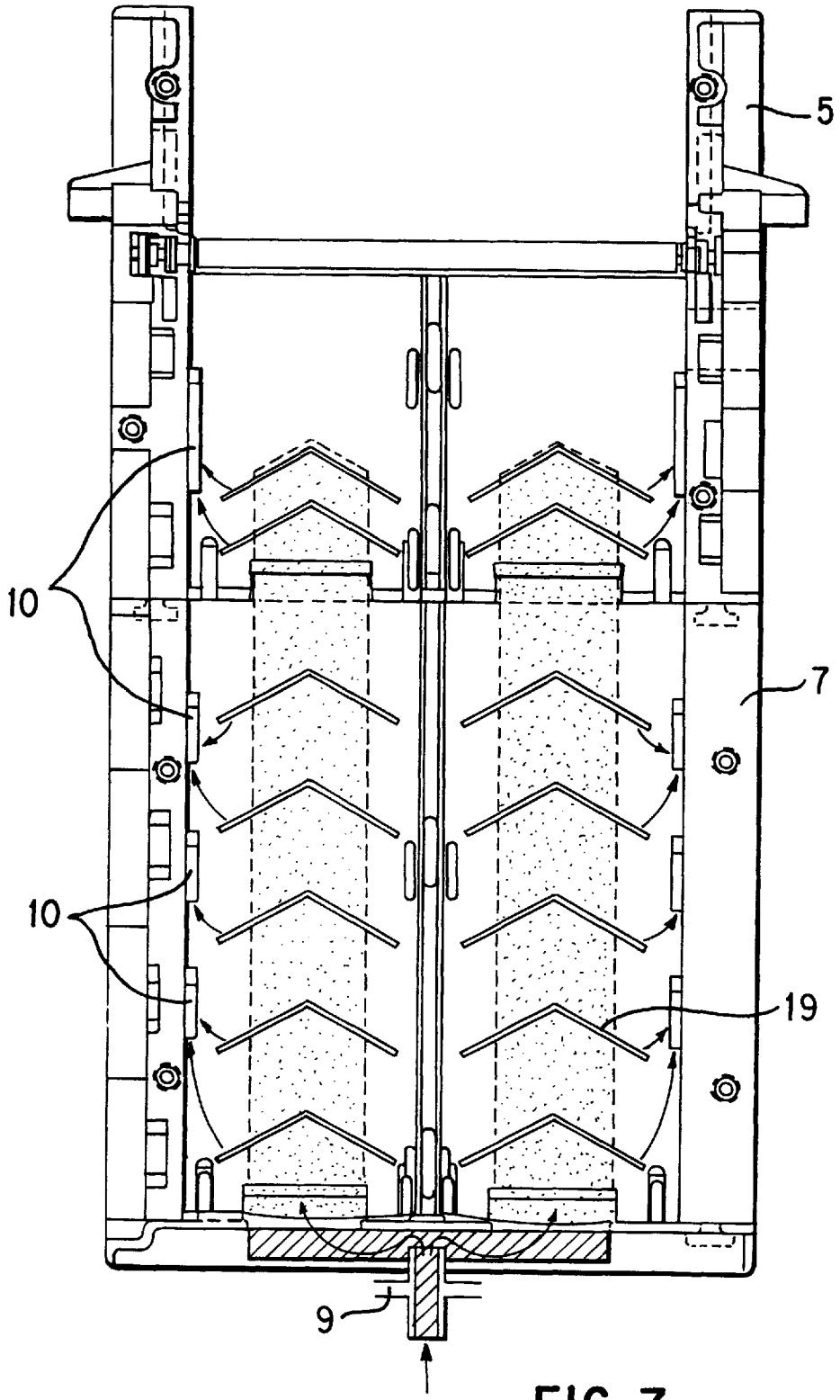
FIG. 7 is a cross-sectional view showing a processing tank in an embodiment of the photosensitive material processing apparatus of the present invention.

FIG. 7 shows a processing tank according to the embodiment. FIG. 7 shows the outlet side of the rack. The processing solution supplied to the bottom of a processing tank 9 is fed upward through the ducts indicated by dots in FIG. 7 and is circulated through the slits 19 or the like, as indicated by arrows. On the outlet side of the rack where the film is transported upward and discharged from the processing tank, each of the slits 19 for jetting the processing solution has an inverted-V-like shape, in which each side is obliquely extended downward from the center of the transport path. Since the slits are inverted-V shaped, it is possible to prevent a short leader or a film from being caught by the slits 19, and also is possible to jet the processing solution uniformly to the film. As indicated by the arrows, the processing solution jetted to the film flows out of the rack through the solution exits 10. In the present embodiment, the outlet-side rack plate 5 and the outlet-side rack plate 7 are joined together for use.

Figure 8:
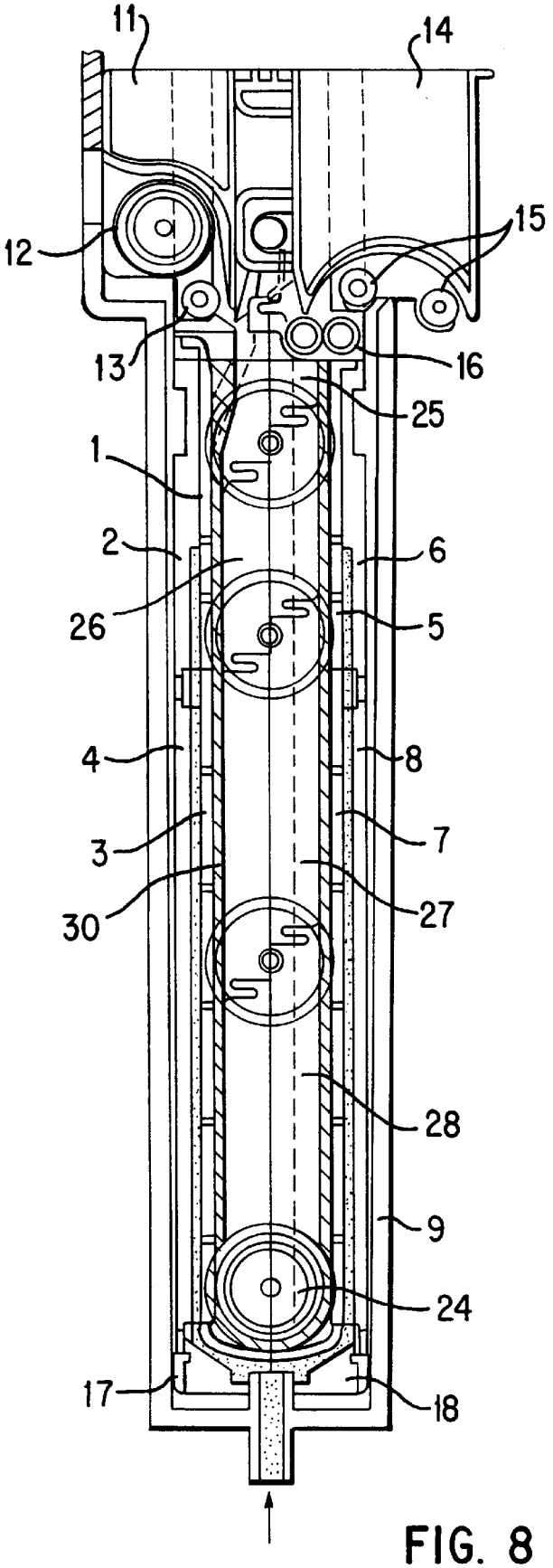
FIG. 8 is a cross-sectional view showing the processing tank in the embodiment of the photosensitive material processing apparatus of the present invention.

FIG. 8 shows the processing tank according to the embodiment. A photosensitive material is fed inside the rack by an inlet turn guide 11 and an inlet turn roller 12, and is transported along the transport path. The photosensitive material is guided by the inlet roller 13 so as to enter the processing solution, and is transported by a feed sprocket or the like, so that the photosensitive material travels downward within the processing tank. The direction of transportation of the photosensitive material is changed to an upward direction at the bottom of the rack, so that the photosensitive material travels upward. At the exit of the rack, the photosensitive material is driven by the exist rollers 16, so that the photosensitive material is taken out from the processing solution. The photosensitive material is then guided by an upper turn roller 15 and an upper turn guide 14, and is discharged from the rack.

On the inlet side of the rack, an inlet-side rack plate 1 and the inlet-side rack plate 3 are joined to each other, and an inlet-side back plate 2 and the inlet-side back plate 4 are attached to their side surfaces. On the outlet side of the rack, an outlet-side rack plate 5 and the outlet-side rack plate 7 are joined to each other, and an outlet-side back plate 6 and the outlet-side back plate 8 are attached to their side surfaces.

The transport paths for films 30 are formed by the spaces between the rack plates and an intermediate plate. Like the rack plates, the intermediate plate is formed by intermediate plates 25, 26, 27 and 28 which are connected together. Feed sprockets or the like are disposed between the two transport paths. In the photosensitive material processing apparatus of the present embodiment, since the rack is formed by connecting parts in the above-described manner, transport paths each having a proper length can be obtained.

At the bottom portion of the rack, there are provided a lower turn roller unit 24, a lower turn guide 17, and a lower turn cover 18. Since the lower turn guide 17 has a curved surface, it can form, in cooperation with the lower turn roller unit 24, transport paths which have no useless spaces. Like the rack plates and the back plates, the lower turn guide 17 and the lower turn cover 18 form ducts for the processing solution. The dotted portions in FIG. 8 serve as the ducts for the processing solution supplied from the solution-introduction port of the processing tank, while the hatched portions show the transport paths.

As described above, in the photosensitive material processing apparatus of the present invention, the inlet-side rack plate 1 and the inlet-side back plate 2, the inlet-side rack plate 3 and the inlet-side back plate 4, the outlet-side rack plate 5 and the outlet-side back plate 6, the outlet-side rack plate 7 and the outlet-side back plate 8, and the lower turn guide 17 and the lower turn cover 18 form ducts which feed the processing solution, supplied to the bottom of the processing tank, from the lower portion to the upper portion in the processing tank.

Figure 9:
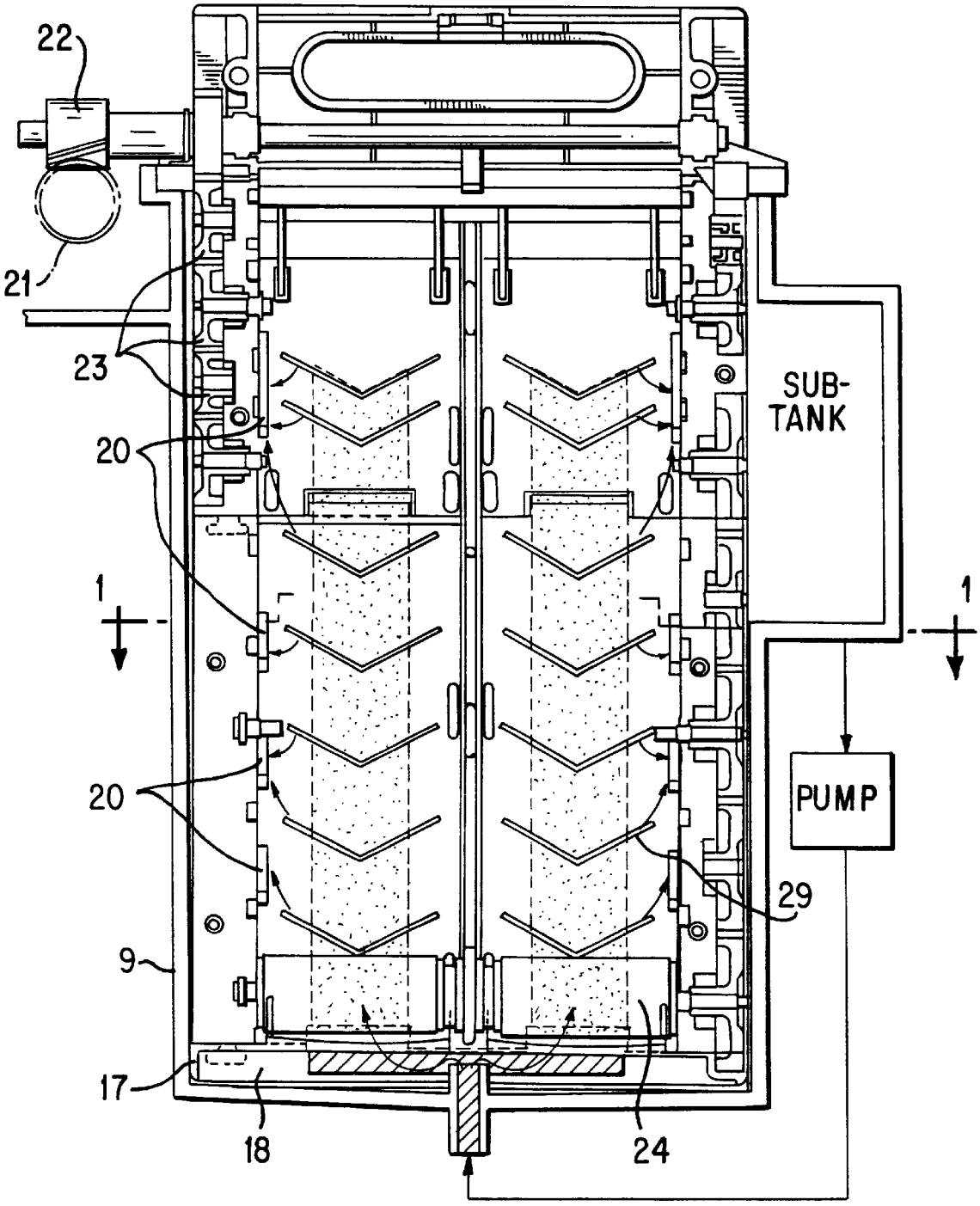
FIG. 9 is an explanatory view of the processing tank in the embodiment of the photosensitive material processing apparatus of the present invention.

FIG. 9 shows the processing tank according to the embodiment. FIG. 9 shows the inlet side of the rack. The ducts for the processing solution are indicated by dots in FIG. 9. After flowing upward within the ducts, the processing solution is jetted from the slits 29 to the films in the transport paths. In addition to the slits 29 for supplying the processing solution into the transport paths, the solution exits 20 are provided so as to circulate the processing solution.

As shown in FIG. 9, on the inlet side of the rack where the film is transported downward, each of the slits 29 for jetting the processing solution has a V-like shape, in which each side is obliquely extended upward from the center of the transport path. Since the slits are V-shaped, it is possible to prevent a short leader or a film from being caught by the slits 29, and also is possible to jet the processing solution uniformly to the film.

In the rack of the photosensitive material processing apparatus of the present embodiment, drive force is transmitted from a worm gear 21 to the sprockets and the rollers via a helical gear 22 and various kinds of transmission gears 23 so as to rotate the sprockets and the rollers. Also, the lower turn guide 17, the lower turn cover 18, and the lower turn roller unit 24 are provided so as to change the direction of transportation of the photosensitive material. Moreover, the lower turn guide 17 and the lower turn cover 18 form a duct.

Figure 10:
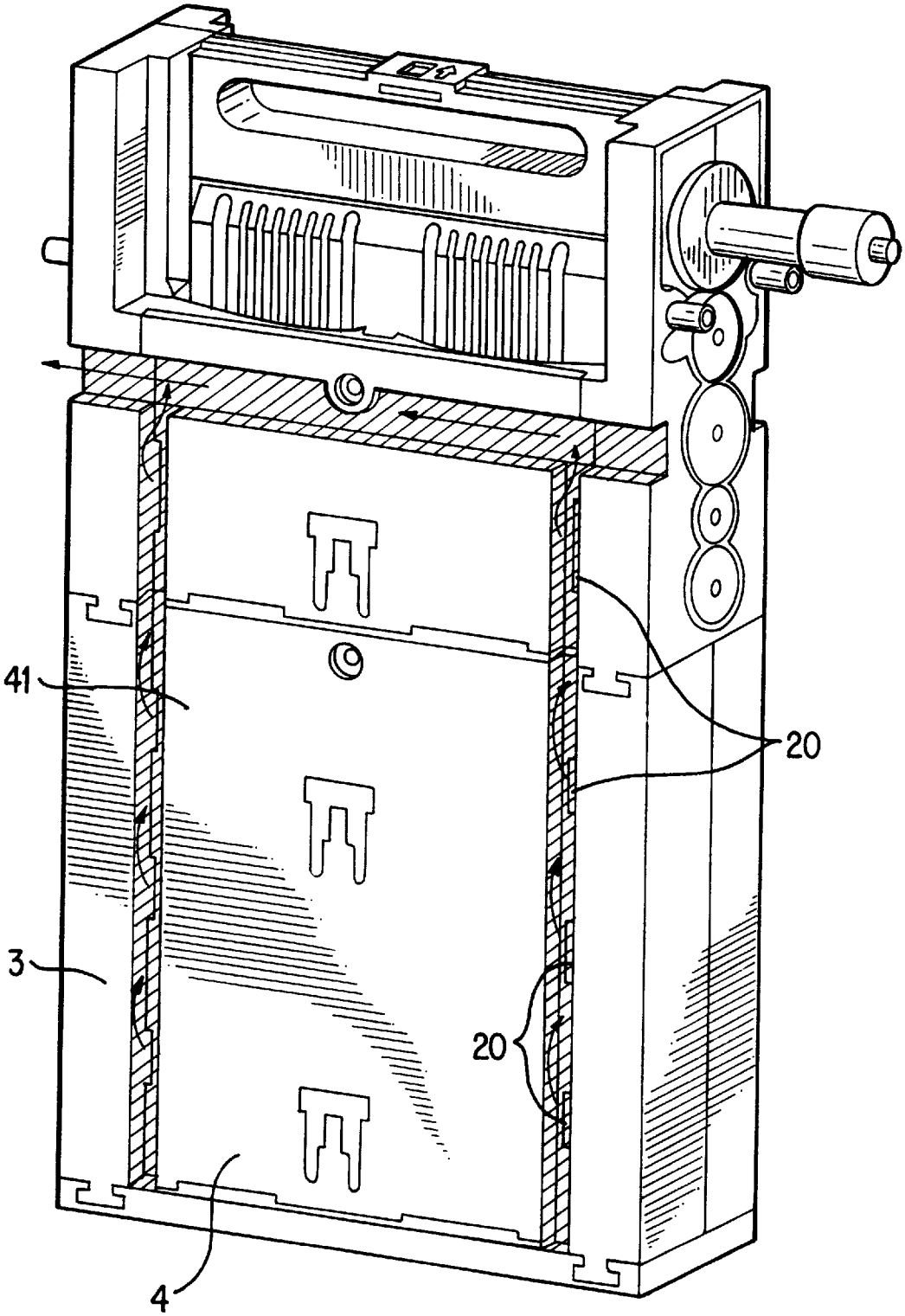
FIG. 10 is a perspective view showing the appearance of the rack used in the embodiment of the photosensitive material processing apparatus of the present invention.

FIG. 10 shows the appearance of the rack used in the embodiment. FIG. 10 shows the inlet side of the rack in which the inlet-side rack plate 3, the inlet-side back plate 4, and the like are shown. The processing solution discharged from the transport paths via the solution exits 20 flows through hatched grooves as indicated by arrows, whereby the processing solution is fed to the subtank.

In the embodiment, a photosensitive material processing apparatus for automatically developing films is shown. However, the present invention is not limited to the embodiment, and can be applied to other types of photosensitive material processing apparatuses in which development process is performed while a photosensitive material is transported using a rack disposed within the processing tank.

As described above, ducts which communicate with the solution-introduction port of the processing tank are formed inside the rack. This is equivalent to the structure in which shower pipes are disposed within the rack. Therefore, it becomes unnecessary for the processing tank to have shower pipes, so that the space for the shower pipes becomes unnecessary. As a result, the size of the processing tank can be decreases by an amount corresponding to the space for the shower pipes, so that the amount of the processing solution and the size of the processing apparatus can be decreased. Since the ducts for the processing solution can be easily disassembled, maintenance and cleaning are facilitated. Since the rack can be disassembled, it is possible to change only a part which requires replacement. This reduces the cost of maintenance. Since ducts for the processing solution, slits for jetting the processing solution, and the solution exit are provided, the processing solution can be circulated in an improved manner, and the performance of the processing solution can be stably maintained.

Obviously, numerous modifications and variations of the present invention are possible in light of the above teachings. It is therefore to be understood that within the scope of the appended claims, the present invention may be practiced otherwise than as specifically described herein.

What is claimed is:

1. A photosensitive material processing apparatus which includes a processing tank having a solution introduction port provided in the bottom wall thereof, and a rack disposed within the processing tank, wherein said rack comprises:

first and second rack parts which are joined together to form a sidewall of said rack and to form a duct therebetween; and third and fourth rack parts which are joined together to form a bottom portion of said rack and to form a duct therebetween;

wherein:

said ducts are connected to said solution introduction port of the processing tank so as to receive a processing solution;

one of said first and second rack parts which forms a transport path for a photosensitive material is provided with slits for jetting the processing solution;

said rack further comprises solution exits, formed in one of said first and second rack parts and adjacent to said slits, which allow the processing solution to flow out from said rack via the transport path;

said first rack part is a rack plate which faces the transport path and has said slits;

said second rack part is a back plate attached to the back of said rack plate so as to form a duct;

said third rack part is a turn guide for changing the direction of transportation of the photosensitive material;

said fourth rack part is a turn cover which is attached to said turn guide so as to form a duct; and said first and second rack parts are provided on either of an inlet side of said rack where the photosensitive material is transported downward and an outlet side of said rack where the photosensitive material is transported upward, and each of slits provided on the inlet side has a V-like shape, while each of slits provided on the outlet side has an inverted-V-like shape.

* * * * *